US009551096B2

(12) United States Patent
Nishino et al.

(10) Patent No.: US 9,551,096 B2
(45) Date of Patent: Jan. 24, 2017

(54) METHOD FOR KNITTING FOOTWEAR

(71) Applicant: Shima Seiki Mfg., Ltd., Wakayama-shi, Wakayama (JP)

(72) Inventors: Kazumi Nishino, Wakayama (JP); Takashi Kino, Wakayama (JP)

(73) Assignee: Shima Seiki Mfg., Ltd., Wakayama-shi, Wakayama (JP)

( * ) Notice: Subject to any disclaimer, the term of this patent is extended or adjusted under 35 U.S.C. 154(b) by 0 days.

(21) Appl. No.: 14/781,702

(22) PCT Filed: Mar. 28, 2014

(86) PCT No.: PCT/JP2014/059117
§ 371 (c)(1),
(2) Date: Oct. 1, 2015

(87) PCT Pub. No.: WO2014/162995
PCT Pub. Date: Oct. 9, 2014

(65) Prior Publication Data

US 2016/0017524 A1 Jan. 21, 2016

(30) Foreign Application Priority Data

Apr. 4, 2013 (JP) ..... 2013-078359

(51) Int. Cl.
*D04B 1/26* (2006.01)
*A43B 1/04* (2006.01)
*D04B 1/10* (2006.01)

(52) U.S. Cl.
CPC . *D04B 1/26* (2013.01); *A43B 1/04* (2013.01); *D04B 1/108* (2013.01); *D10B 2501/043* (2013.01)

(58) Field of Classification Search
CPC ..... D04B 1/108; D04B 1/26; D04B 1/1265; D04B 7/32

(Continued)

(56) References Cited

U.S. PATENT DOCUMENTS 4,909,048 A * 3/1990 Stoll ..... D04B 7/26 66/127
5,584,197 A * 12/1996 Okuno ..... D04B 1/24 66/172 R (Continued)

FOREIGN PATENT DOCUMENTS

WO 2008/143172 A1 11/2008

OTHER PUBLICATIONS

International Search Report cited in PCT/JP2014/059117 dated Jun. 5, 2014, 1 page.

*Primary Examiner* — Danny Worrell
(74) *Attorney, Agent, or Firm* — Rothwell, Figg, Ernst & Manbeck, P.C.

(57) ABSTRACT

It is an objective of the present invention to provide a method for knitting a novel knitted fabric in which a stitch direction on an instep side is orthogonal to a stitch direction on a sole side using a flat knitting machine.

In a sole section (4), a pickup stitch (8) in which a cover section (3) continues to a left side and a right side of the sole section (4) is formed while moving a stitch row of a BB, which becomes a part of a toe section (2), toward one side (right) in a knitting width direction. In the cover section (3), a three-dimensional cover section (3) is formed by carrying out a narrowing knitting while forming a new stitch following a stitch row of an FB of the toe section (2), a stitch row of an BB of the toe section (2) in which the pickup stitch (8) is formed on a left side (12) and a right side (13) of the sole section (4) while being moved toward the right, and a stitch row of the pickup stitch (8).

6 Claims, 3 Drawing Sheets

(58) Field of Classification Search
USPC ..... 66/64, 65, 69, 178 R, 185–187
See application file for complete search history.

(56) References Cited

U.S. PATENT DOCUMENTS 5,682,771 A * 11/1997 Forest ..... B60N 2/58
66/169 R
6,182,474 B1 * 2/2001 Bruelemans ..... D04B 1/24
66/170
7,059,156 B2 * 6/2006 Takeda ..... A41B 11/004
66/186
7,263,860 B2 * 9/2007 Okuno ..... D04B 1/18
66/64
7,437,895 B2 * 10/2008 Okuno ..... A41D 19/00
66/174
8,434,331 B2 * 5/2013 Funaki ..... D04B 1/108
66/174

* cited by examiner

METHOD FOR KNITTING FOOTWEAR

CROSS REFERENCE TO RELATED APPLICATION

This application is a 35 U.S.C. 371 National Phase Entry Application from PCT/JP2014/059117, filed Mar. 28, 2014, which claims the benefit of Japanese Patent Application No. JP2013-078359 filed on Apr. 4, 2013, the disclosure of which is incorporated herein in its entirety by reference.

TECHNICAL FIELD

The present invention relates to a method for knitting a footwear.

BACKGROUND ART

A footwear such as shoes and socks has been conventionally knitted with a flat knitting machine including front and back needle beds. For example, in patent document 1, the respective knitted fabrics knitted with knitting needles of the front and back needle beds are coupled at both ends, and a sock is formed as a seamless tubular knitted fabric. Such sock has a stitch row circling in a course direction continuing in a wale direction, where a first tubular portion and a second tubular portion obtained by the tubular knitting are formed as portions that cover the toe region and the ankle region. The stitch direction is the direction from the toe toward the foot inserting opening or the opposite direction. Between the tubular portions is a heel portion that is formed through a C-shaped knitting of alternately inverting the direction of feeding the yarn between the front needle bed and the back needle bed.

PRIOR ART DOCUMENT

Patent Document

[Patent Document 1] International Patent Publication No. 08/078623 pamphlet

DISCLOSURE OF THE INVENTION

Problems to be Solved by the Invention

The sock has been shown in patent document 1, but is basically a tubular knitted fabric circling knitted between the toe and the foot inserting opening, where the direction of the stitches is one direction. As opposed to such tubular knitting, a new knitted fabric in which the stitch direction of a cover section on the instep side is orthogonal to the stitch direction of the sole is desired to change the direction of patterns parallel to the sole or the stretching direction of the knitted fabric.

It is an objective of the present invention to provide a method for knitting a novel knitted fabric in which a stitch direction of a cover section on an instep side is orthogonal to a stitch direction of a sole using a flat knitting machine.

Means for Solving the Problems

In a method for knitting a footwear with an upper section in which a toe section, a cover section on an instep side, and a sole section on a sole side are integrated using a flat knitting machine including at least a front and back needle bed and in which stitches are transferable between the front and back needle beds, the method including: process 1 of knitting the toe section using the front and back needle beds; process 2 of knitting the sole section by repeating knitting of a new stitch row following a stitch row of one needle bed holding some stitches of the toe section, moving of the new stitch row to one side in a knitting width direction and forming of a pickup stitch, to become a left side and a right side of the sole section, on a knitting needle, which became an empty needle by the movement, and an empty needle facing an end in the moving direction of the moved new stitch row; process 3 of transferring some stitches configuring the sole section to the opposing needle bed; and process 4 of knitting the cover section by repeating knitting of a new stitch row to a tubular form or a C-shaped form toward a wale direction with respect to the stitches configuring an outer peripheral edge of the sole section.

The knitting of the cover section in process 4 includes carrying out a narrowing knitting with respect to the stitch at an end of the respective stitch row held on the front and back needle beds, and providing an inclination of the cover section from the toe section to the foot inserting opening.

In the knitting of the vicinity of a terminating end of the sole section in process 2, the reduction of the stitches at the end of the left side and the right side of the sole section is repeatedly carried out when knitting a new stitch row.

The knitting of the upper section includes knitting with a knitting yarn containing a non-thermal adhesive yarn and a thermal adhesive yarn, and a part of at least the cover section is knitted using only the non-thermal adhesive yarn.

Effects of the Invention

According to present invention, the footwear in which the stitch direction of the cover section on the instep side is orthogonal to the stitch direction of the sole can be knitted.

Furthermore, according to the present invention, the narrowing knitting is carried out with respect to the stitches at the end of the respective stitch rows held on the front and back needle beds so that the inclination of the cover section from the toe section to the foot inserting opening can be easily provided, whereby a footwear that fits the foot can be obtained.

Moreover, according to the present invention, a heel portion that fits can be formed by shaping the sole section through the narrowing knitting in the vicinity of the terminating end of the sole section.

According to the present invention, when forming a robust upper section with the knitting yarn containing the non-thermal adhesive yarn and the thermal adhesive yarn, a region of one part of the cover section knitted using only the non-thermal adhesive yarn does not become firm and such area can be easily bent.

MODE FOR CARRYING OUT THE INVENTION

Figure 3:
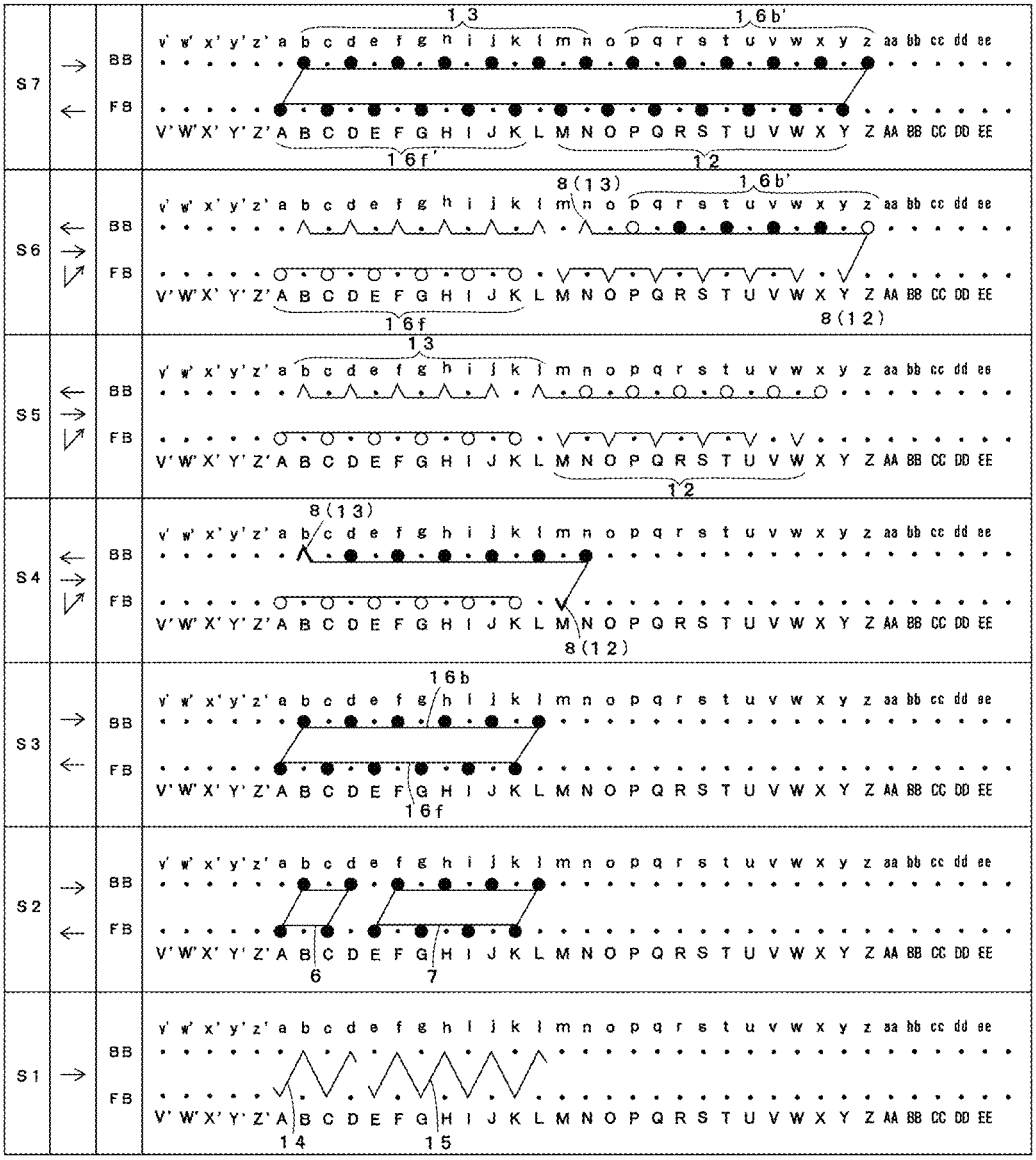
FIG. 3 is a knitting process diagram showing a first half in a knitting procedure of the footwear 10 according to the example of the present invention.
Figure 4:
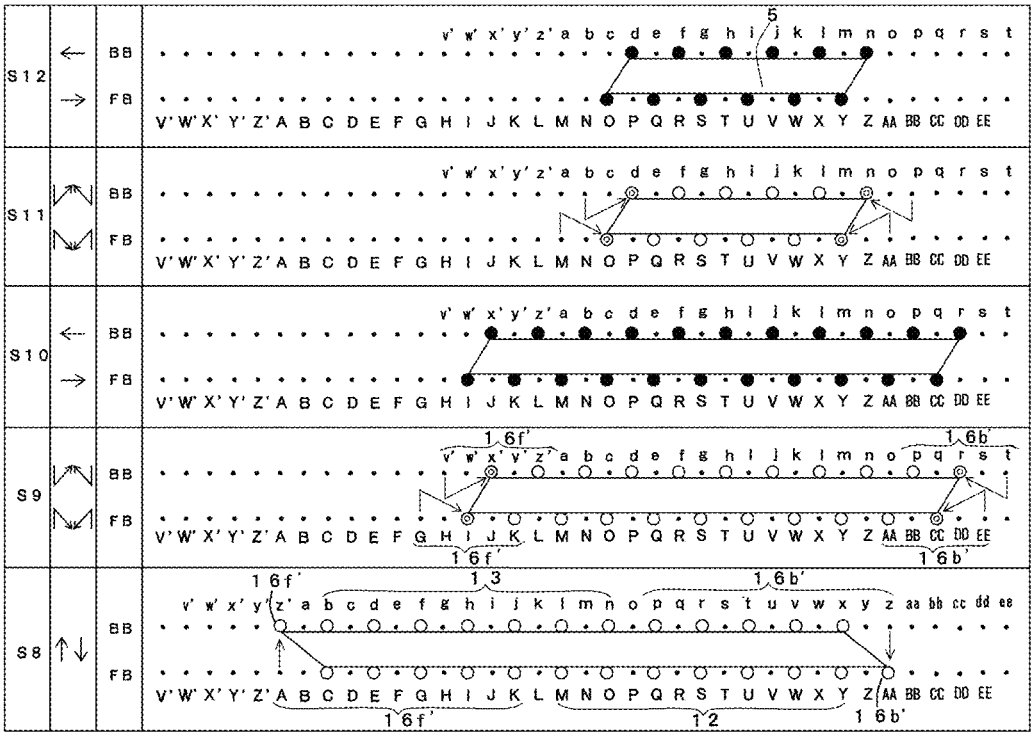
FIG. 4 is a knitting process diagram showing a second half in the knitting procedure of the footwear 10 according to the example of the present invention.

Hereinafter, a method for knitting a footwear 10 serving as one example of the present invention will be described using an image of the footwear 10 in FIG. 1, a schematic view of knitting of FIG. 2, and knitting process diagrams of FIGS. 3 and 4. A flat knitting machine to use is a two-bed flat knitting machine including a front and back needle bed, where knitting is carried out in a half-gauge state using every other knitting needles. For the sake of convenience of explanation, the number of knitting needles in the knitting process diagrams is less than the footwear 10 of FIG. 1. In FIGS. 3 and 4, the numbers on the left side in the figure indicate a knitting step (S), and the arrow in the up and down direction and the bent arrow in the figure indicate the transfer direction. FB indicates a front needle bed, and BB indicates a back needle bed. The upper case letters V' to EE indicate the knitting needles of the FB, and the lower case letters v' to ee indicate the knitting needles of the BB. A black circle mark indicates a stitch formed in the knitting step, a circle mark indicates a stitch held on the knitting needle, a double circle mark indicates the double stitches held on the knitting needle, and a V mark indicates a pickup stitch.

Example

Figure 1:
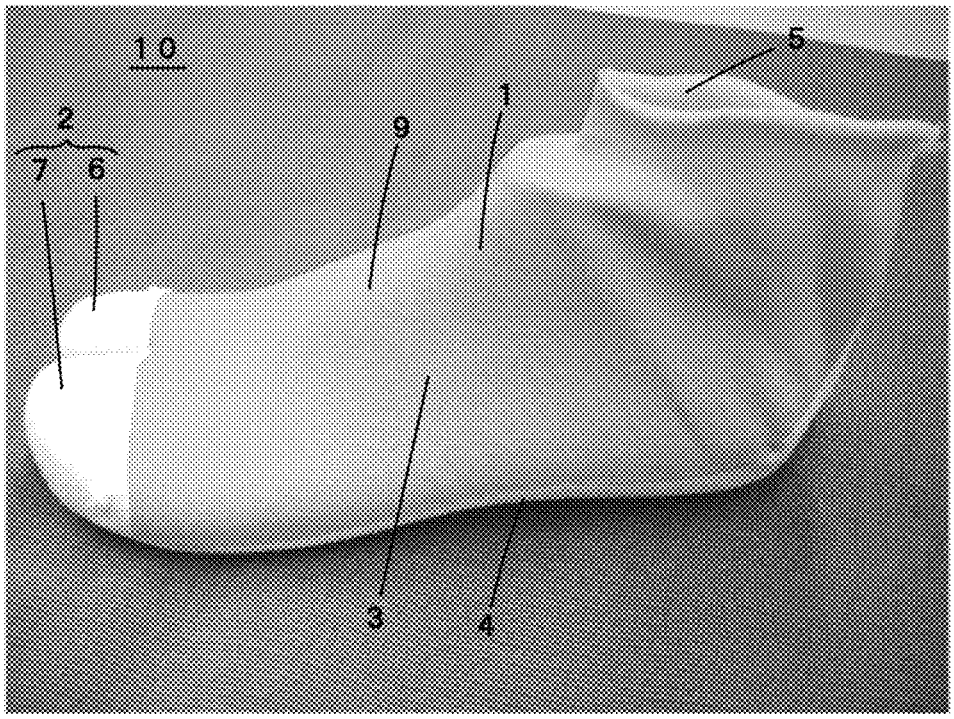
FIG. 1 is an image of a footwear 10 according to an example of the present invention.

FIG. 1 is an image showing the footwear 10 according to an example of the present invention. In the footwear 10, a toe section 2 including two finger tubular portions 6, 7 is formed to a tabi-sock shape, and the stitch direction of a cover section 3 is orthogonal to a sole section 4. Furthermore, the color of the knitting yarns for the cover section 3 and the sole section 4 is also different. When knitting the cover section 3, a narrowing knitting is carried out with respect to the stitches at the respective knitted fabric ends held on the front and back needle beds on the instep side, and a center line 9 of the cover section 3 is formed from a front portion of a foot inserting opening 5 toward a finger base.

Figure 2:
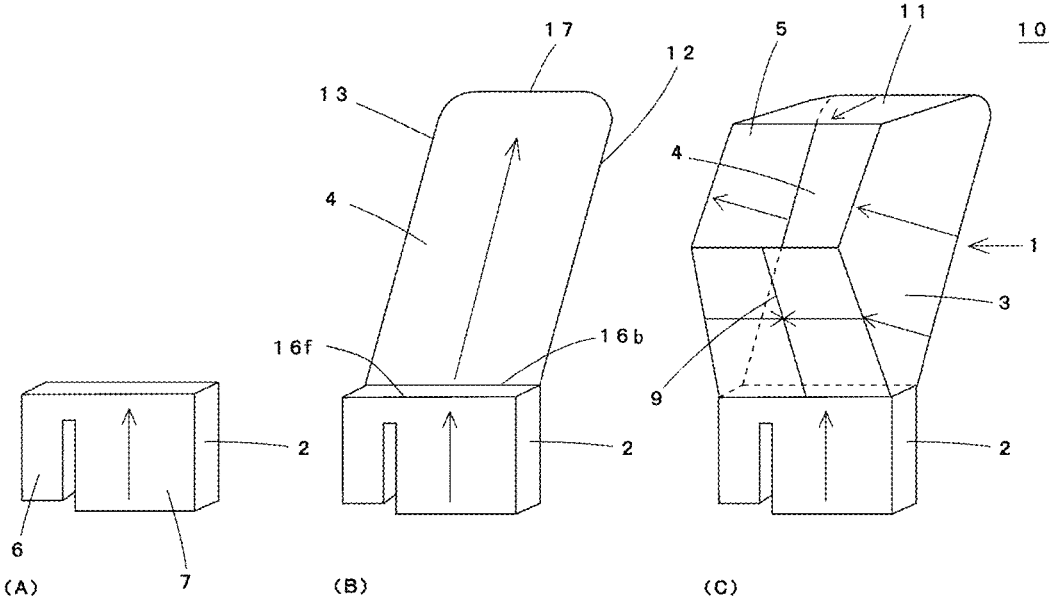
FIG. 2 is a schematic view of knitting of the footwear 10 according to the example of the present invention.

FIG. 2 is a schematic view of the knitting of the footwear 10. The knitting progression of each region of the toe section 2, the sole section 4, and the cover section 3 to be knitted is shown with (A) to (C). Each region of the toe section 2, the sole section 4, and the cover section 3 is sequentially knitted and joined to form an integrated upper section 1. In the figure, the knitting direction (wale direction) of each region is indicated with an arrow. In (A), the toe section 2 configuring a finger tubular portion 6 for the big toe and a finger tubular portion 7 for toes other than the big toe has a thick tabi-sock shape, but may be rounded at the tip or may have five finger tubular portions.

FIG. 2(B) is a view showing addition of the sole section 4 with respect to FIG. 2(A). A starting end stitch row 16*f* of the FB that becomes a part of the toe section 2 shown in FIG. 3, to be described later, is held as is on the knitting needles of the FB, and a starting end stitch row 16*b* of the BB is moved to one side (right side) in the knitting direction while the knitting of the sole section 4 is carried out and the left side 12 and the right side 13 to which the cover section 3 continues are formed up to a terminating end stitch row 17. FIG. 2(C) is a view showing addition of the cover section 3 with respect to FIG. 2(B). The narrowing knitting is carried out to match the shape of the heel in the vicinity of the heel portion 11 while forming new stitches following the starting end stitch row 16*f* of the FB of the toe section 2, the terminating end stitch row 17 held on the knitting needles of the BB moved to the right side, and the stitch rows indicated as the left side 12 and the right side 13, thus forming a three-dimensional cover section 3. In this case, the narrowing knitting is carried out to incline the instep side with respect to the stitches at the knitted fabric end on the instep side, so that the center line 9 is formed by the double stitches of the narrowing knitting from the front portion of the foot inserting opening 5 toward the toe section 2.

FIG. 3 is a knitting diagram showing a first half of the knitting procedure of the footwear 10. In S1, a set-up of the finger tubular portion 6 for the big toe and the finger tubular portion 7 for the toes other than the big toe to become the toe section 2 is knitted. The yarn is fed from different yarn feeders to the knitting needles A, b, C, d and the knitting needles E, f, G, h, I, j, K, l of the front needle bed FB and the back needle bed BB (hereinafter indicated as FB, BB) to form pickup stitches, and a set-up 14 of the finger tubular portion 6 for the big toe and a set-up 15 of the finger tubular portion 7 for toes other than the big toe are provided. The FB side is the stitches on the instep side and the BB side is the stitches on the sole side.

In S2, the tubular knitting is carried out on each set-up 14, 15 of the finger tubular portion 6 and the finger tubular portion 7 set up in S1, respectively, and the length of the finger tubular portion is adjusted by the number of circling knitting. The finger tubular portion 6 for the big toe knits a new stitch following the stitches held on the knitting needles C, A of the FB and the knitting needles b, d of the BB. The finger tubular portion 7 for the toes other than the big toe knits a new stitch following the stitches held on the knitting needles K, I, G, E of the FB and the knitting needles f, h, j, l of the BB. In the present example, two finger tubular portions are simultaneously knitted using different yarn feeders, but the finger tubular portion 6 may be formed first with one yarn feeder, and then the finger tubular portion 7 may be formed with the same yarn feeder.

In S3, a knitting of connecting the finger tubular portion 6 and the finger tubular portion 7 is carried out. A new stitch following the stitches held on the knitting needles K, I, G, E, C, A of the FB and the knitting needles b, d, f, h, j, l of the BB is knitted. The adjacent stitches of the two finger tubular portions may be overlapped, or the tuck knitting may be carried out across the boundary of the two finger tubular portions so that holes are prevented from forming at the finger base portion. Furthermore, the stitches held on the knitting needles b, d, f, h, j, l of the BB become the starting end stitch row 16*b* to become the starting end of the sole section 4. The toe section 2 of the portion indicated with (A) of FIG. 2 can be knitted with the knitting of S1 to S3.

In S4, the stitches held on the knitting needles b, d, f, h, j, l of the BB to become the stitch row of one part of the toe section 2, that is, the stitches of the starting end stitch row 16*b* to become the starting end of the sole section 4 are moved to the knitting needles d, f, h, j, l, n of the BB through the empty needle of the FB. After such movement, the pickup stitch 8 is knitted on the knitting needle b of the BB, which became the empty needle, and the knitting needle M of the FB facing the knitting needle n, and a new stitch is knitted continuing to the stitches held on the knitting needles d, f, h, j, l, n of the BB. The pickup stitch 8 formed on the knitting needle b becomes the first stitch forming the right side 13 of the sole section 4 and the pickup stitch 8 formed on the knitting needle M becomes the first stitch 12 forming the left side of the sole section 4.

S5 shows a state in which the knitting similar to S4 is repeated another five times, and the desired length of the sole section 4 is obtained while moving the sole section 4 toward the right side. A new stitch row 16*b*' knitted continuing to the starting end stitch row 16*b* of the BB to become the starting end of the sole section 4 is moved with the same number of stitches up to the vicinity of the terminating end of the sole section 4 without increasing nor decreasing the number of stitches. In S6, following the new stitch row 16*b*' knitted continuing to the starting end stitch row 16*b* of the BB in which a new stitch of the same number is formed while being moved toward the right side to S3 to S5, the two stitches (knitting needles p, z) at both ends are miss knitted to match the shape of the heel thus reducing the stitches to knit. When forming the heel portion 11, the knitting for shaping the area to become the vicinity of the terminating end of the sole section 4 is carried out. The pickup stitch 8 is knitted on the new stitch row 16*b*' following the stitches held on the knitting needles r, t, v, x, and the knitting needle n of the BB and the knitting needle Y of the FB.

In S7 a new stitch is knitted following the stitches configuring the outer peripheral edge of the sole section 4 including the pickup stitches 8 to become the left side 12 and the right side 13 of the sole section 4. A new stitch following the stitches held on every other knitting needles from the knitting needle Y toward the knitting needle A of the FB is knitted, and a new stitch following the stitches held on every other knitting needles from the knitting needle b toward the knitting needle z of the BB is knitted. According to the knitting of S4 to S7, the sole section 4 added to (B) of FIG. 2 can be knitted. A new stitch row 16*f*' knitted continuing the starting end stitch row 16*f* of the FB serving as the instep side is held on the knitting needles A, C, E, G, I, K of the FB, the new stitch row 16*b*' serving as the heel portion 11 side is held on the knitting needles p, r, t, v, x, z of the BB, the stitch row of the right side 13 of the sole section 4 is held on the knitting needles b, d, f, h, j, l of the BB, and the stitch row of the left side 12 of the sole section 4 is held on the knitting needles M, O, Q, S, U, W, Y of the FB.

FIG. 4 is a knitting view showing a second half of the knitting procedure of the footwear 10. In S8, the knitting of rotating the tubular knitted fabric of S7 in the clockwise direction is shown. That is, the stitch row 16*f*' on the instep side and the stitch row of the left side 12 of the sole section 4 are held on the FB, the stitch row 16*b*' on the heel portion 11 side and the stitch row of the right side 13 of the sole section 4 are held on the BB, and the instep side is facing the front (FB side), but the transfer of the knitted fabric in the clockwise direction is repeated at both left and right ends of the tubular knitted fabric to move the stitch row 16*f*' on the sole side to be located on the left side in the longitudinal direction of the front and back needle beds. The BB is racked by one needle toward the right, the stitch held on the knitting needle A of the FB is transferred to the knitting needle z', and the stitch held on the knitting needle z of the BB is transferred to the knitting needle AA. Similar knitting is carried out two times, so that the stitch row 16*f*' on the instep side is located on the left side in the longitudinal direction of the needle bed, and the stitch row on the instep side is equally arranged by three stitches on the FB and the BB. In this case, the stitch row 16*b*' on the heel portion 11 side of the BB is also equally arranged by three stitches on the FB and the BB. That is, the position of the center line 9 of the cover section 3 is moved from between the knitting needle E and the knitting needle G of the FB to between the FB and the BB.

In S9, the knitting of matching to the shape of the foot is carried out through the narrowing knitting from the state in which the stitch row 16*f*' on the instep side and the stitch row 16*b*' on the heel portion 11 side are equally arranged on the FB and the BB by the rotation of S8. In the state the front and back knitted fabrics are rotated in the clockwise direction from S7, the narrowing knitting is carried out on the stitches at the end of the respective stitch row held on the front and back needle beds to form an inclination on the instep side at the leftward side in the longitudinal direction of the needle bed. As a result, the center line 9 is formed by the double stitches of the narrowing knitting. The shape along the heel portion 11 is formed with the narrowing knitting on the rightward side of the needle bed. The footwear 10 that fits the foot is obtained by such knitting. On the instep side, the stitch held on the knitting needle v' of the BB is moved to the knitting needle x', and the stitch held on the knitting needle G of the FB is moved to the knitting needle I to form the double stitches. On the heel portion 11 side, the stitch held on the knitting needle t of the BB is moved to the knitting needle r, and the stitch held on the knitting needle EE of the FB is moved to the knitting needle CC to form the double stitches.

In S10, the knitting is carried out in the wale direction toward the foot inserting opening 5 including also the double stitches formed through the narrowing knitting of S9. A new stitch is formed with every other knitting needles from the knitting needle CC toward the knitting needle I of the FB, and a new stitch is formed with every other knitting needles from the knitting needle x' toward the knitting needle r of the BB. S11 shows a state in which the knitting similar to S9 and S10 are repeated three times is shown. The inclination on the instep side is arranged on the leftward side of the needle bed, and the heel portion 11 is formed on the rightward side of the needle bed. In S12, the tubular knitting is carried out after carrying out the narrowing knitting up to the desired number of stitches of the aperture of the foot inserting opening 5. The tubular knitting of S12 is repeated, and the stitches at the terminating end are prevented from unraveling through the known bind-off stitches. According to the knitting of S8 to S12, the portion added to (C) of FIG. 2 can be knitted.

The material (knitting yarn) has not been mentioned in the present example, but the knitting yarn and the knitting method can be changed since each knitting region can be made independent, as shown in (A) to (C) of FIG. 2. The knitting process diagram shows the plain structure, but the sole section 4 may be formed thick through a double-sided structure using a humidity absorbing/antibacterial material, and the cover section 3 may be formed with a mesh structure to have satisfactory aeration. Furthermore, a knitting yarn including a non-thermal adhesive yarn and a thermal adhesive yarn may be used for the shoes upper. A firm upper can be formed through thermal adhesion, but in this case, the position near the ankle region, for example, which is not to be thermally adhered is knitted with the thermal adhesive yarn to carry out circling knitting in which the stitch direction of the cover section 3 is directed in the foot inserting opening direction. A shoes that can easily bend along the movement of the foot thus can be formed.

DESCRIPTION OF REFERENCE NUMERALS

1 upper section
2 toe section
3 cover section
4 sole section
5 foot inserting opening
6, 7 finger tubular portion

The invention claimed is:

1. A method for knitting a footwear (10) with an upper section (1) in which a toe section (2), a cover section (3) on an instep side, and a sole section (4) on a sole side are integrated using a flat knitting machine including at least a front and back needle bed and in which stitches are transferable between the front and back needle beds; the method for knitting the footwear (10) comprising:

process 1 of knitting the toe section (2) using the front and back needle beds;

process 2 of knitting the sole section (4) by repeating knitting of a new stitch row following a stitch row of one needle bed holding some stitches of the toe section (2), moving of the new stitch row to one side in a knitting width direction and forming of a pickup stitch (8), to become a left side (12) and a right side (13) of the sole section (4), on a knitting needle, which became an empty needle by the movement, and an empty needle facing an end in the moving direction of the moved new stitch row;

process 3 of transferring some stitches configuring the sole section (4) to the opposing needle bed; and process 4 of knitting the cover section (3) by repeating knitting of a new stitch row to a tubular form or a C-shaped form toward a wale direction with respect to the stitches configuring an outer peripheral edge of the sole section (4).

2. The method for knitting the footwear (10) according to claim 1, characterized in that the knitting of the cover section (3) in process 4 includes carrying out a narrowing knitting with respect to the stitch at an end of the respective stitch row held on the front and back needle beds, and providing an inclination (9) of the cover section (3) from the toe section (2) to the foot inserting opening (5).

3. The method for knitting the footwear (10) according to claim 1, characterized in that in the knitting of the vicinity of a terminating end of the sole section (4) in process 2, the reduction of the stitches at the end of the left side (12) and the right side (13) of the sole section (4) is repeatedly carried out when knitting a new stitch row.

4. The method for knitting the footwear (10) according to claim 1, characterized in that the knitting of the upper section (1) includes knitting with a knitting yarn containing a non-thermal adhesive yarn and a thermal adhesive yarn, and a part of at least the cover section (3) is knitted using only the non-thermal adhesive yarn.

5. The method for knitting the footwear (10) according to claim 2, characterized in that in the knitting of the vicinity of a terminating end of the sole section (4) in process 2, the reduction of the stitches at the end of the left side (12) and the right side (13) of the sole section (4) is repeatedly carried out when knitting a new stitch row.

6. The method for knitting the footwear (10) according to claim 2, characterized in that the knitting of the upper section (1) includes knitting with a knitting yarn containing a non-thermal adhesive yarn and a thermal adhesive yarn, and a part of at least the cover section (3) is knitted using only the non-thermal adhesive yarn.

* * * * *